US010316559B2

(12) United States Patent
Kenerly et al.

(10) Patent No.: US 10,316,559 B2
(45) Date of Patent: Jun. 11, 2019

(54) DOOR HINGE ASSEMBLY

(71) Applicants: Kedrick Dean Kenerly, Hoschton, GA (US); Wayne Robert Thomas, Jefferson, GA (US)

(72) Inventors: Kedrick Dean Kenerly, Hoschton, GA (US); Wayne Robert Thomas, Jefferson, GA (US)

(73) Assignee: KENERLY ENTERPRISES, LLC, Cleveland, GA (US)

( * ) Notice: Subject to any disclaimer, the term of this patent is extended or adjusted under 35 U.S.C. 154(b) by 0 days.

(21) Appl. No.: 13/663,422

(22) Filed: Oct. 29, 2012

(65) Prior Publication Data

US 2013/0104341 A1 May 2, 2013

(51) Int. Cl.
*E05D 11/00* (2006.01)
*E05D 3/02* (2006.01)
*E05D 5/16* (2006.01)

(52) U.S. Cl.
CPC ..... *E05D 3/02* (2013.01); *E05D 5/16* (2013.01); *E05Y 2201/632* (2013.01); *E05Y 2800/422* (2013.01); *E05Y 2900/132* (2013.01); *Y10T 16/537* (2015.01)

(58) Field of Classification Search
CPC . Y10T 16/537; Y10T 16/5373; Y10T 16/557; E05D 3/02; E05D 11/02; E05Y 2201/632; E05Y 2800/422; E05Y 2800/412
USPC ..... 16/274, 273, 386
See application file for complete search history.

(56) References Cited

U.S. PATENT DOCUMENTS

| | | | | | |
|---|---|---|---|---|---|
| 179,409 | A | * | 7/1876 | Hopkins | 16/273 |
| 1,027,716 | A | * | 5/1912 | Fletcher | 16/273 |
| 1,824,886 | A | * | 9/1931 | Hart | 16/257 |
| 2,024,985 | A | * | 12/1935 | Brantingson | 16/246 |
| 2,214,348 | A | * | 9/1940 | Roth | 16/274 |
| 2,588,216 | A | * | 3/1952 | De Graaf | 16/274 |
| 3,451,124 | A | * | 6/1969 | Steiner et al. | 29/527.1 |
| 3,499,183 | A | * | 3/1970 | Parsons | 16/273 |
| 3,546,735 | A | * | 12/1970 | Liautaud | 16/228 |
| 3,725,973 | A | * | 4/1973 | Gwozdz | 16/273 |

(Continued)

FOREIGN PATENT DOCUMENTS

| | | | |
|---|---|---|---|
| CN | 201162419 Y | * | 12/2008 |
| DE | 2851234 A | * | 6/1980 |
| WO | WO 9428454 A1 | * | 12/1994 |

*Primary Examiner* — Chuck Y Mah
(74) *Attorney, Agent, or Firm* — Bradley D. Crose; Crose Law LLC

(57) ABSTRACT

A door hinge assembly is provided. The door hinge assembly includes a first hinge plate, a second hinge plate, one or more bushings, a hinge pin and a hollow sleeve. The first and second hinge plate includes a one or more first and second knuckles aligned axially. At least one of the one or more bushings is positioned in between the first and second knuckle to prevent direct contact of first and second knuckle. The hinge pin is disposed through the first and second knuckles and one or more bushings. The hollow sleeve acts a covering to the hinge pin. The hollow sleeve further prevents contact of the sides of the first knuckle, bushings and second knuckle with the hinge pin. This prevents a direct metal on metal contact and further prevents squeak or other noises occurred during the opening and closing of the door.

11 Claims, 3 Drawing Sheets

(56) References Cited

U.S. PATENT DOCUMENTS

| | | | | | |
|---|---|---|---|---|---|
| 3,921,225 | A | * | 11/1975 | Suska | 16/273 |
| 4,419,788 | A | * | 12/1983 | Prout | 16/300 |
| 4,964,193 | A | * | 10/1990 | Rommelfaenger et al. | 16/225 |
| 5,761,769 | A | * | 6/1998 | Bruckner et al. | 16/342 |
| 6,125,508 | A | * | 10/2000 | Formenti | 16/335 |
| 6,460,220 | B1 | * | 10/2002 | Jackson | 16/285 |
| 7,000,289 | B2 | * | 2/2006 | Cedrone | 16/309 |
| 7,290,310 | B2 | * | 11/2007 | Yamaguchi | 16/273 |

* cited by examiner

DOOR HINGE ASSEMBLY

The present application claims the benefit of U.S. application Ser. No. 61/553,792, filed Oct. 31, 2011 and titled "Squeak-free, PTFE enhanced, door hinge", which is herein incorporated by reference in its entirety.

BACKGROUND OF THE INVENTION

The invention generally relates to door hinges, and more particularly relates to a squeak-free door hinge.

A hinge is a type of bearing that connects two solid objects, typically allowing only a limited angle of rotation between them. Two objects connected by an ideal hinge either rotate relative to each other about a fixed axis of rotation or one object remains stationary while the other rotates relative to the stationary object, about a fixed axis of rotation.

While there are a variety of door hinges, the barrel hinge is the most common and is characterized as a sectional barrel secured by a pivot. A barrel is a component of this type of hinge which has a hollow cylinder shaped section where the rotational bearing force is applied to the pivot.

A barrel hinge typically has two plates having adjoining knuckles. One plate is attached to the door and the other plate is attached to the door frame. A hinge pin is used to join both the plates. Metal to metal joints between the ends of the knuckles and pin often bind during use, resulting in the creation of squeaks or other noise. The friction of opening and closing the door also causes metal dust and corrosion as well as squeaking.

Various processes are known to remove the squeaking sound but they are generally a temporary fix as well as being messy.

U.S. Pat. No. 4,573,239 discloses a three knuckle hinge, wherein the bearing inserts are placed in the single knuckle leaf and the two knuckle leaf is then aligned therewith and the hinge pin elements are inserted and engaged with the two knuckle leaf to prevent relative rotation therebetween. However, the arrangement explained in the U.S. Pat. No. 4,573,239 doesn't completely remove the metal on metal contact.

U.S. Pat. No. 5,463,795 discloses a hinge comprising a first hinge, a second hinge, bearing assemblies and a hinge pin. Desirably, the bearing assembly further includes retaining means retaining the body portion of the thrust bearing within the counter bore of the bushing. However, the hinge doesn't provide means for reducing the squeak or noise as the hinge arrangement has metal assembly.

US Published Patent Application Number 2006/0156512 discloses a single axis hinge comprising a pair of leaves having knuckles, a hinge pin and one annular bush. The single axis hinge provides a single axis hinge wherein the aforementioned problems of wear are substantially alleviated. Further, a pair of hinge pins is provided each fixed to a respective leaf knuckle and having end-to-end bearing inter-engagement within one of said knuckles with face-to-face bearing engagement of the respective knuckles thus maintaining a metal to metal contact.

The foregoing patent, patent publication and non-patent information reflect the state of the art of which the inventors are aware and is tendered with a view toward discharging the inventors' acknowledged duty of candor in disclosing information that may be pertinent to the patentability of the technology described herein. It is respectfully stipulated, however, that the foregoing patent and other information do not teach or render obvious, singly or when considered in combination, the inventors' claimed invention.

Therefore, there is a need for a door hinge assembly which eliminates metal-to-metal contact and prevents squeaking, as well as the repetitive need for any messy lubrication or replacement of the door hinge.

SUMMARY OF THE INVENTION

In accordance with the teachings of present invention, a squeak-free door hinge assembly is provided.

The squeak-free door hinge assembly is comprised of the following components:

- a first hinge plate
- a second hinge plate
- bushings
- a hinge pin assembly
  - a hinge pin
  - a hollow sleeve In one embodiment of the technology described herein the hinge pin assembly is directed to a door hinge having an axial continuous passage therein, a hinge pin assembly comprising a hinge pin and a sleeve having a recess therein, the sleeve dimensioned for insertion of the hinge pin into the recess, the sleeve further dimensioned for insertion into the axial continuous passage, wherein the sleeve consists of PTFE. The hinge pin assembly can be further comprised of a package containing at least one of a set of a hinge pin and a hollow sleeve.

In other embodiments the hollow sleeve can consist of a material that is either coated with PTFE or has an outer layer of PTFE.

The first hinge plate is attached to a door and is comprised of knuckles having an axial continuous passage.

The second hinge plate is attached to a corresponding door frame and is comprised of knuckles having an axial continuous passage. The knuckles of second hinge plate are axially aligned with the knuckles of first hinge plate.

The bushings prevent direct contact of the knuckles of first hinge plate with the knuckles of second hinge plate. The bushings can consist of a material of 100% PTFE, a non-PTFE inner material with an outer layer of PTFE, or an outer coating of PTFE.

A hinge pin assembly connects the first hinge plate, the bushings and the second hinge plate. The hinge pin assembly is comprised of a hinge pin and a hollow sleeve.

The hollow sleeve covers the hinge pin and prevents direct contact of the sides of the first hinge plate, the second hinge plate and the bushings with the hinge pin.

In one embodiment of the technology described herein the door hinge assembly comprises a first hinge plate having one or more first knuckles with an axial continuous passage; a second hinge plate having one or more second knuckles with an axial continuous passage, the one or more second knuckles extending between and axially aligned with the one or more first knuckles; one or more bushings to prevent direct contact of the one or more first knuckles with the one or more second knuckles, at least one of the one or more bushings positioned between the one or more first knuckles and the one or more second knuckles; a hinge pin assembly comprising a hinge pin and a hollow sleeve, the hinge pin inserted in the hollow sleeve, the hinge pin passes through the one or more first knuckles, the one or more bushings and the one or more second knuckles to connect first hinge plate and the second hinge plate and the hollow sleeve to protect direct contact of the hinge pin with the sides of the one or more first hinge plate, one or more second hinge plate and the one or more bushings with the one or more bushings further comprising a PTFE coating, the hollow sleeve further comprising a PTFE coating, the first hinge plate and the second hinge plate formed from a low carbon steel metal, the hinge pin formed from low carbon steel, attachment means, e.g. screws and the like, to attach the first hinge plate to a door and the second hinge plate to a corresponding door frame, and the first hinge plate comprising one or more first recesses and the second hinge plate comprising one or more second recesses to allow the attachment means to connect the first hinge plate to door and the second hinge plate to door's frame.

In another embodiment of the technology described herein a door hinge assembly comprises a first hinge plate having one or more first knuckles with an axial continuous passage, the first hinge plate further having one or more first recesses; a second hinge plate having one or more second knuckles with an axial continuous passage, the one or more second knuckles extending between and axially aligned with the one or more first knuckles, the second hinge plate further having one or more second recesses; one or more bushings to prevent direct contact of the one or more first knuckles with the one or more second knuckles, at least one of the one or more bushings positioned between the one or more first knuckles and the one or more second knuckles; a hinge pin assembly comprising a hinge pin and a hollow sleeve, the hinge pin inserted in the hollow sleeve, the hinge pin passes through the one or more first knuckles, the one or more bushings and the one or more second knuckles to connect first hinge plate and the second hinge plate and the hollow sleeve to protect direct contact of the hinge pin with the sides of the one or more first hinge plate, one or more second hinge plate and the one or more bushings; and one or more attachment means to attach first hinge plate to a door through one or more first recesses and second hinge plate to a door frame through one or more second recesses, where the one or more bushings comprises a material coated with PTFE, the hollow sleeve comprises a material coated with PTFE, the first hinge plate, the second hinge plate and the hinge pin are comprised of low carbon steel metal, the one or more bushings and the hollow sleeve are comprised of a material made of PTFE.

In yet another embodiment of the technology described herein a hinge pin assembly for a door hinge having an axial continuous passage therein, the hinge pin assembly comprises a hinge pin and a sleeve having a recess therein, the sleeve dimensioned for insertion of the hinge pin into the recess, and the sleeve further dimensioned for insertion into the axial continuous passage, the sleeve being comprised of completely of PTFE, just the outer coating of PTFE, or an inner layer of non-PTFE material and an outer layer of PTFE.

An aspect of the technology described herein is to provide a door hinge assembly having a first and a second hinge plate, one or more bushings and a hinge pin assembly.

An aspect of the technology described herein is to provide a door hinge assembly that prevents the metal on metal contact by incorporating PTFE elements.

An aspect of the technology described herein is to provide a door hinge assembly that eliminates the use of lubricants.

An aspect of the technology described herein is to provide a door hinge assembly made with low carbon steel.

An aspect of the technology described herein is to provide a door hinge assembly made with components having a PTFE coating.

Another aspect of the technology described herein is to provide a door hinge assembly having three knuckles for first hinge plate and two knuckles for second hinge plate.

DETAILED DESCRIPTION OF THE INVENTION

Figure 1:
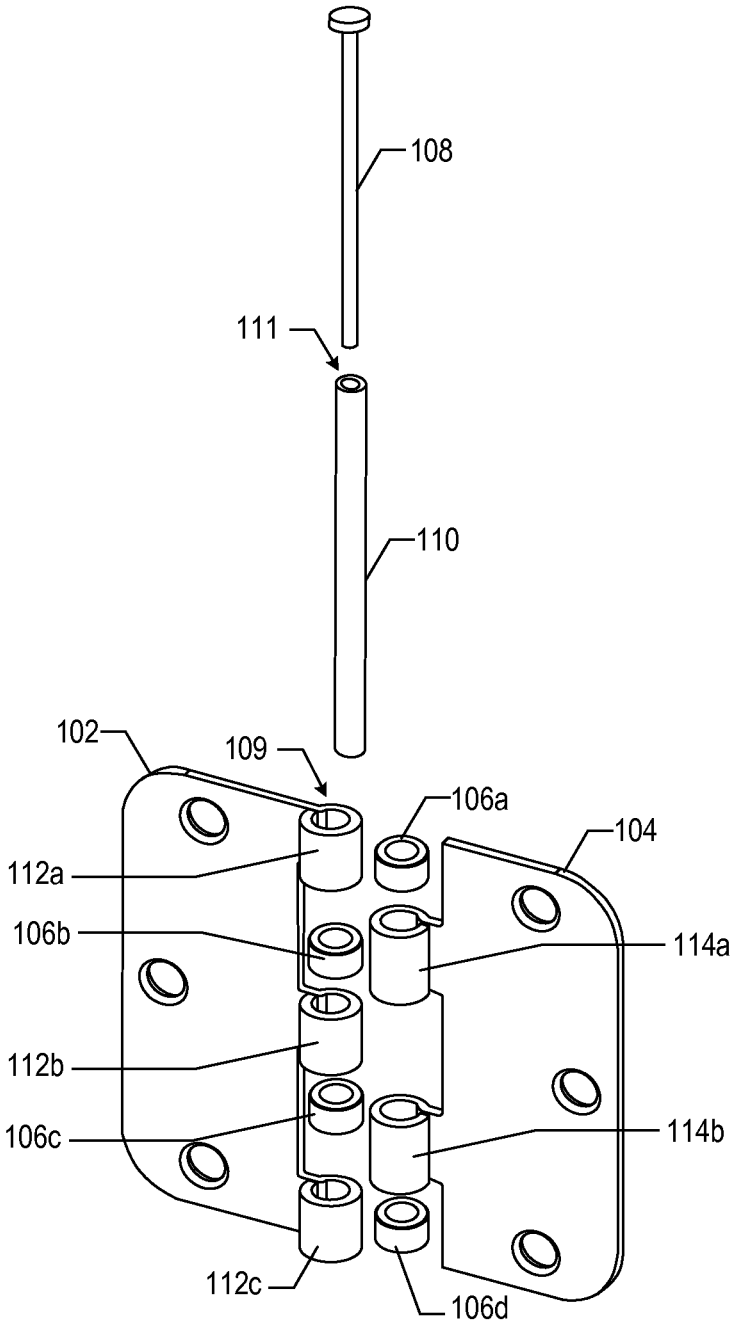
FIG. 1 illustrates an exploded view of a door hinge assembly, in accordance with a preferred embodiment of the technology described herein.

While this invention is illustrated and described in a preferred embodiment, the door hinge assembly may be produced in many different configurations, forms and materials. There is depicted in the drawings, and will herein be described in detail, as a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the technology described herein.

Reference will now be made in detail to several embodiments of the invention which are illustrated in the accompanying drawings. Wherever feasible and convenient, the same reference numerals are used in the figures and the description to refer to the same or like parts. The drawings are in a simplified form and not to precise scale. For purposes of convenience and clarity only, directional terms, such as top, bottom, left, right, up, down, over, above, below, beneath, rear, and front may be used with respect to the accompanying drawings. These and similar directional terms should not be strictly construed to limit the scope of the invention. In addition, words such as attached, affixed, coupled, connected and similar terms with their inflectional morphemes are used interchangeably, unless the difference is noted or made otherwise clear from the context. These words and expressions do not necessarily signify direct connections, but include connections through mediate components and devices.

FIG. 1 illustrates an exploded view of a door hinge assembly 100 in accordance with a preferred embodiment of the technology. The door hinge assembly 100 includes a first hinge plate 102, second hinge plate 104, one or more bushings 106, a hinge pin assembly including a hinge pin 108 and a hollow sleeve 110 with hollow interior 111. The first hinge plate 102 includes one or more first knuckles 112 such as 112*a*, 112*b* and 112*c* with an axial continuous passage 109.

The second hinge plate 104 includes one or more second knuckles 114 such as 114*a* and 114*b* with an axial continuous passage 109. The one or more second knuckles 114 extending between and further axially aligned with the one or more first knuckles 112. The one or more bushings 106 such as 106*a*, 106*b*, 106*c* and 106*d* prevents direct contact of the one or more first knuckles 112 with the one or more second knuckles 114. At least one of the one or more bushings 106 to be positioned between the one or more first knuckles 112 and the one or more second knuckles 114.

A hinge pin 108 is disposed in the hollow sleeve 110 and thus the hollow sleeve 110 incorporated with the hinge pin 108 passes through the one or more first hinge plate 102, the one or more second hinge plate 104 and the one or more bushings 106. The hollow sleeve 110 protects direct contact of the hinge pin 108 with the sides of the one or more first hinge plate 102, the one or more second hinge plate 104 and the one or more bushings 106.

Figure 2:
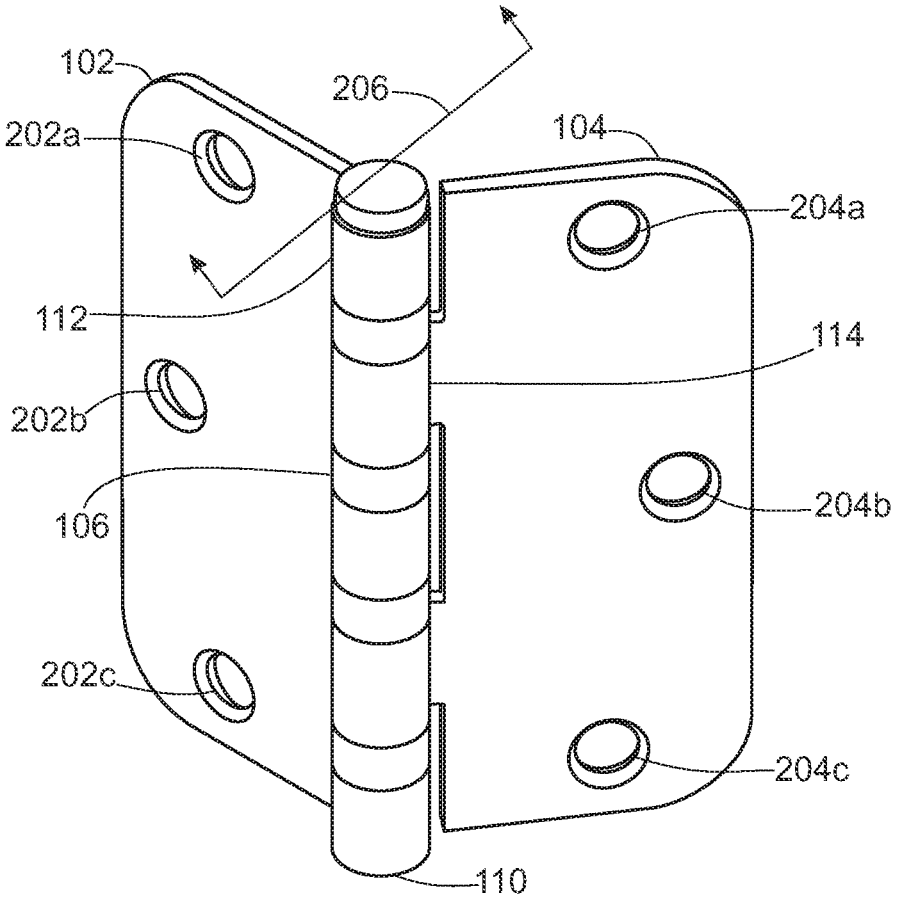
FIG. 2 illustrates a perspective view of the door hinge assembly, in accordance with a preferred embodiment of the technology described herein.

FIG. 2 illustrates a perspective view of the door hinge assembly 100. The first hinge plate 102 further includes one or more first recesses 202 such as 202*a*, 202*b* and 202*c*. The second hinge plate 104 further includes one or more second recesses 204 such as 204*a*, 204*b* and 204*c*. In a preferred embodiment of the present invention, the door hinge assembly 100 one or more attachment means (not shown in Figures) to attach first hinge plate 102 to the door through one or more recesses 202 and the second hinge plate 104 to the door's frame through one or more recesses 204.

FIG. 2 also indicates the axial alignment of the hinge pin (not visible) disposed in the hollow sleeve 110 with the one or more first knuckles 112, the one or more bushings 106 and the one or more second knuckles 114. A double sided arrow 206 indicating the movement of the first hinge plate 102 attached to the door. The hinge pin 108 allows the first hinge plate 102 to open and close the door.

Figure 3:
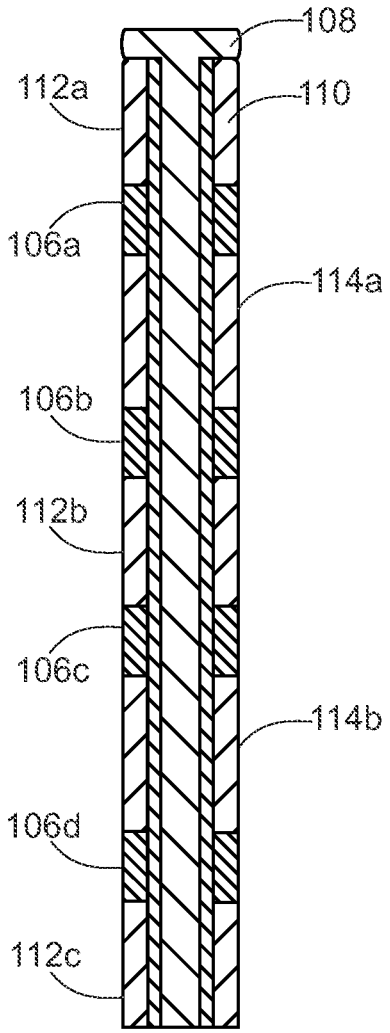
FIG. 3 illustrates a cross-sectional view of a hinge pin assembly, in accordance with a preferred embodiment of the technology described herein.

FIG. 3 illustrates a cross-sectional view of the hollow sleeve 110 and the hinge pin 108, in accordance with a preferred embodiment of the technology. The cross-sectional view indicates the arrangement of the one or more bushings 106 in between the one or more first knuckle 112 and the one or more second knuckle 114.

In a preferred embodiment of the present invention, the one or more bushings 106 and the one or more hollow sleeve 110 are made up of PTFE. The first hinge plate 102 and the second hinge plate 104 are made up of with low carbon steel.

In a preferred embodiment of the present invention, the bushings 106 have a height of 0.125 inch. The hinge pin 108 has a thickness of 0.14 inch. The length of the hinge plates (102, 104) is 3.500 inch and the width is 1.700 inch from the center of the continuous passage to the outside edge of the left or right hinge plate. The width of top and bottom knuckles of the first hinge plate 102 is 0.5 inch and the width of middle knuckle of first hinge plate 102 is 0.625 inch in width. The top and bottom knuckle of the second hinge plate 104 is 0.6875 inch in width. The length of the hinge pin 108 is 3.625 inch. The hollow sleeve 110 dimensions are 3.5 inches in length, with an interior diameter of 0.14 inches and an exterior diameter of 0.234 inches.

The door hinge assembly 100 offers various advantages. The door hinge assembly 100 prevents metal on metal contact, thus eliminating the squeak produced during the opening and closing of the door. The door hinge assembly 100 eliminates the need for lubricants and other temporary solutions to reduce squeaking or metal-on-metal grating by incorporating PTFE components to eliminate metal-on-metal contact.

REFERENCE NUMBER TABLE

| Ref. # | Description |
|---|---|
| 100 | Door Hinge Assembly |
| 102 | First Hinge Plate |
| 104 | Second Hinge Plate |
| 106 | Bushing |
| 108 | Hinge Pin |
| 110 | Hollow Sleeve |

-continued

| Ref. # | Description |
|---|---|
| 112 | First Knuckles |
| 114 | Second Knuckles |
| 202 | First Recesses |
| 204 | Second Recesses |

The foregoing discussion discloses and describes merely exemplary embodiments of the technology described herein. One skilled in the art will readily recognize from such discussion and from the accompanying drawings that various changes, modifications and variations can be made therein without departing from the spirit and scope of the invention. For example, variances in the dimensions, finishes, types of metal, non-stick materials other than PTFE, applications other than door hinges, etc.

We claim:

1. A door hinge assembly comprising:

a first hinge plate having one or more first knuckles with an axial continuous passage, the first knuckles having a first knuckles horizontal plane across both of a bottom and a top surface of each knuckle that is perpendicular to a first vertical axis of the first hinge plate;

a second hinge plate having one or more second knuckles with an axial continuous passage, the second knuckles having a second knuckles horizontal plane across both of a bottom and a top surface of each knuckle that is perpendicular to a second vertical axis of the second hinge plate, the one or more second knuckles extending between and axially aligned with the one or more first knuckles;

one or more non-metal, lubricant-free bushings to prevent direct contact of the one or more first knuckles with the one or more second knuckles, at least one of the one or more bushings positioned between the one or more first knuckles and the one or more second knuckles, wherein each bushing is uniform in height that is parallel to the axis of the respective hinge plate, for placement between the first and second knuckles, wherein each bushing has a bushing horizontal axis across both of a bottom and a top surface that is perpendicular to both the first vertical axis of the first hinge plate and the second vertical axis of the second hinge plate;

a lubricant-free hinge pin assembly comprising a hinge pin and a PTFE, lubricant-free, hollow sleeve, having a hollow interior therein, the hollow sleeve having a length generally that of a full length of the hinge pin, the hinge pin inserted in the hollow interior of the hollow sleeve to prevent metal-on-metal contact between the hinge pin and the hinge knuckles, the hinge pin passes through the one or more first knuckles, the one or more bushings and the one or more second knuckles to connect first hinge plate and the second hinge plate and the hollow sleeve to protect direct contact of the hinge pin with the sides of the one or more first hinge plate, one or more second hinge plate and the one or more bushings;

wherein the hinge pin assembly is configured to eliminate any need for lubricants and to prevent metal-on-metal contact and grating.

2. The door hinge assembly according to claim 1, the one or more bushings further comprising a PTFE coating.

3. The door hinge assembly according to claim 1, wherein the first hinge plate and the second hinge plate is formed from a low carbon steel metal.

4. The door hinge assembly according to claim 1, wherein the hinge pin is formed from low carbon steel.

5. The door hinge assembly according to claim 1, further comprising attachment means to attach the first hinge plate to a door and the second hinge plate to a corresponding door frame.

6. The door hinge assembly according to claim 1, wherein the first hinge plate comprises one or more first recesses and the second hinge plate comprises one or more second recesses to allow the attachment means to connect the first hinge plate to door and the second hinge plate to a corresponding door frame.

7. A door hinge assembly comprising:

a first hinge plate having one or more first knuckles with an axial continuous passage, the first knuckles having a first knuckles horizontal axis plane across both of a bottom and a top surface of each knuckle that is perpendicular to a first vertical axis of the first hinge plate, and the first hinge plate further having one or more first recesses;

a second hinge plate having one or more second knuckles with an axial continuous passage, the second knuckles having a second knuckles horizontal axis place across both of a bottom and a top surface of each knuckle that is perpendicular to a second vertical axis of the second hinge plate, the one or more second knuckles extending between and axially aligned with the one or more first knuckles, the second hinge plate further having one or more second recesses;

one or more non-metal, lubricant-free bushings to prevent direct contact of the one or more first knuckles with the one or more second knuckles, at least one of the one or more bushings positioned between the one or more first knuckles and the one or more second knuckles, wherein each bushing is uniform in height that is parallel to the axis of the respective hinge plate, for placement between the first and second knuckles, wherein each bushing has a bushing horizontal axis across both of a bottom and a top surface that is perpendicular to both the first vertical axis of the first hinge plate and the second vertical axis of the second hinge plate;

a lubricant-free hinge pin assembly comprising a hinge pin and a PTFE, lubricant-free, hollow sleeve, having a hollow interior therein, the hollow sleeve having a length generally that of a full length of the hinge pin, the hinge pin inserted in the hollow interior of the hollow sleeve to prevent metal-on-metal contact between the hinge pin and the hinge knuckles, the hinge pin passes through the one or more first knuckles, the one or more bushings and the one or more second knuckles to connect first hinge plate and the second hinge plate and the hollow sleeve to protect direct contact of the hinge pin with the sides of the one or more first hinge plate, one or more second hinge plate and the one or more bushings; and one or more attachment means to attach first hinge plate to a door through one or more first recesses and second hinge plate to a door's frame through one or more second recesses;

wherein the hinge pin assembly is configured to eliminate any need for lubricants and to prevent metal-on-metal contact and grating.

8. The door hinge assembly according to claim 7, wherein one or more bushings comprises a material coated with PTFE.

9. The door hinge assembly according to claim 7, wherein the first hinge plate and the second hinge plate comprises low carbon steel metal.

10. The door hinge assembly according to claim 9, wherein the hinge pin comprises low carbon steel.

11. The door hinge assembly according to claim 7, wherein one or more bushings comprises a material made of PTFE.

* * * * *